US007619620B2

(12) United States Patent
Fujita et al.

(10) Patent No.: US 7,619,620 B2
(45) Date of Patent: Nov. 17, 2009

(54) TEST CIRCUIT, ELECTRO-OPTICAL DEVICE, AND ELECTRONIC APPARATUS

(75) Inventors: Shin Fujita, Suwa (JP); Hiroko Oka, Azumino (JP)

(73) Assignee: Epson Imaging Devices Corporation, Azumino-shi (JP)

( * ) Notice: Subject to any disclaimer, the term of this patent is extended or adjusted under 35 U.S.C. 154(b) by 631 days.

(21) Appl. No.: 11/431,518

(22) Filed: May 11, 2006

(65) Prior Publication Data

US 2006/0279313 A1 Dec. 14, 2006

(30) Foreign Application Priority Data

May 20, 2005 (JP) ..... 2005-148071

(51) Int. Cl.
*G09G 5/00* (2006.01)

(52) U.S. Cl. ..... 345/204; 345/76

(58) Field of Classification Search ..... 345/76, 345/204

See application file for complete search history.

(56) References Cited

U.S. PATENT DOCUMENTS

| | | | | |
|---|---|---|---|---|
| 7,187,204 | B2 * | 3/2007 | Tanada | 326/52 |
| 7,205,986 | B2 | 4/2007 | Osada | |
| 7,265,572 | B2 * | 9/2007 | Osada | 324/770 |
| 7,446,737 | B2 * | 11/2008 | Maede et al. | 345/76 |
| 7,518,602 | B2 * | 4/2009 | Nozawa | 345/204 |
| 7,528,817 | B2 * | 5/2009 | Osada | 345/98 |
| 2001/0040565 | A1 * | 11/2001 | Koyama | 345/204 |
| 2004/0239598 | A1 * | 12/2004 | Koyama | 345/76 |

FOREIGN PATENT DOCUMENTS

| | | |
|---|---|---|
| JP | A-08-062580 | 3/1996 |
| JP | A-2004-212984 | 7/2004 |

* cited by examiner

*Primary Examiner*—Amare Mengistu
*Assistant Examiner*—Premal Patel
(74) *Attorney, Agent, or Firm*—Oliff & Berridge, PLC

(57) ABSTRACT

A test circuit for detecting an output signal from a driving circuit includes a judging circuit which outputs a detection signal when the output signal output from the driving circuit has one polarity, but does not output the detection signal when the output signal has the other polarity, and an amplifying circuit which amplifies the signal from the judging circuit.

3 Claims, 12 Drawing Sheets

RELATED ART

RELATED ART

TEST CIRCUIT, ELECTRO-OPTICAL DEVICE, AND ELECTRONIC APPARATUS

BACKGROUND

1. Technical Field

The present invention relates to a test circuit for a data line driving circuit or a scanning line driving circuit of an electro-optical device using liquid crystal, to an electro-optical device having such a test circuit, and to an electronic apparatus having such an electro-optical device.

2. Related Art

In the related art, electro-optical devices, such as liquid crystal display devices for displaying images, are known. An electro-optical device has, for example, a liquid crystal panel, and a driving circuit for driving the liquid crystal panel. In such an electro-optical device, in order to check the operations of the driving circuit, there is provided a test circuit which checks the operations of the driving circuit by hitting a test probe (see Japanese Patent No. 3203971). Such an electro-optical device has, for example, the following configuration.

Overall Configuration of Electro-Optical Device

FIG. 14 is a block diagram showing the configuration of an electro-optical device 101 according to the related art.

The electro-optical device 101 has a liquid crystal panel AA, a power supply circuit 2 which supplies power to the liquid crystal panel AA, an image processing circuit 3 which supplies image signals to the liquid crystal panel AA, and a timing generating circuit 4 which outputs clock signals or start signals to the image processing circuit 3 or the liquid crystal panel AA.

The power supply circuit 2 supplies driving signals VDDY, VSSY, VHHY, VLLY, VDDX, VSSX, VHHX, and VLLX to the liquid crystal panel AA.

The image processing circuit 3 performs the gamma (γ) correction on input image data D in consideration of light transmittance characteristics of the liquid crystal panel, generates the image signals by performing the D/A conversion of image data D of individual RGB colors, and supplies the image signals to the liquid crystal panel AA.

The timing generating circuit 4 generates a Y clock signal YCK, an inverted Y clock signal YCKB, an X clock signal XCK, an inverted X clock signal XCKB, a Y transmission start signal DY, and an X transmission start signal DX in synchronization with input image data D input to the image processing circuit 3.

The timing generating circuit 4 supplies the Y transmission start signal DY, the Y clock signal YCK, and the inverted Y clock signal YCKB of these signals to a scanning line driving circuit 20 (described below) of the liquid crystal panel AA. Further, the timing generating circuit 4 supplies the X transmission start signal DX, the X clock signal XCK, and the inverted X clock signal XCKB to a data line driving circuit 30 (described below) of the liquid crystal panel AA. In addition, the timing generating circuit 4 generates various timing signals and outputs them to the image processing circuit 3.

The liquid crystal panel AA has an element substrate on which thin film transistors (hereinafter, referred to as TFTs) 13 are arranged in a matrix shape as switching elements, a counter substrate which is disposed to face the element substrate, and liquid crystal which is provided between the element substrate and the counter substrate.

On the element substrate of the liquid crystal panel AA, in addition to a pixel matrix 10, the scanning line driving circuit 20, and the data line driving circuit 30, test circuits 121 and 131 are formed.

In the pixel matrix 10, a plurality of scanning lines 11 provided at predetermined intervals, and data lines 12 provided to intersect the scanning lines 11 at predetermined intervals are formed. At each of the intersections between the scanning lines 11 and the data lines 12, the TFT 13, a pixel electrode 14, and a storage capacitor 15 are provided.

A gate of the TFT 13 is connected to the scanning line 11, a source of the TFT 13 is connected to the data line 12, and a drain of the TFT 13 is connected to the pixel electrode 14.

Each pixel has the pixel electrode 14, a counter electrode 16 formed on the counter substrate, and liquid crystal 17 provided between both electrodes. Accordingly, in the pixel matrix 10, a plurality of pixels are arranged in a matrix shape.

The scanning line driving circuit 20 drives the individual scanning lines 11 of the pixel matrix 10, and the data line driving circuit 30 drives the individual data lines 12 of the pixel matrix 10.

Specifically, the scanning line driving circuit 20 sequentially transmits the Y transmission start signal DY in synchronization with the Y clock signal YCK and the inverted Y clock signal YCKB, such that scanning signals are linear-sequentially applied to the individual scanning lines 11 in a pulsed manner. Therefore, if the scanning signal is supplied to a scanning line 11, the TFT 13 connected to the scanning line 11 is turned on, and all pixels relating to the scanning line 11 are selected.

Further, the data line driving circuit 30 sequentially transmits the X transmission start signal DX as a trigger signal in synchronization with the X clock signal XCK and the inverted X clock signal XCKB. Accordingly, the image signals are sequentially supplied to the individual data lines 12, and are sequentially written into the pixel electrodes 14 of the pixels through the TFT 13 which is in the ON state. The voltage of each pixel electrode 14 is held by the storage capacitor 15 for a longer time, namely, for a period as much as three orders of magnitude longer than the time for which the image signal is written.

Here, by changing the voltage level of the image signal, the alignment or order of liquid crystal changes according to the applied voltage, such that gray-scale display by light modulation of each pixel can be performed. For example, in case of a normally white mode, the amount of light passing through liquid crystal decreases as the applied voltage increases. In case of a normally black mode, as the applied voltage increases, the amount of light passing through liquid crystal increases. Therefore, in the liquid crystal panel AA, light having contrast according to the image signal is emitted from each pixel, such that the image is displayed.

Configuration of Driving Circuit

FIG. 15 is a circuit diagram of the data line driving circuit 30 and the test circuit 131 constituting the liquid crystal display device 101 according to the related art.

The data line driving circuit 30 is a shift register which has n shift register unit circuits A1 to An and n−1 logical arithmetic unit circuits B1 to B(n−1). Here, n is a natural number of 2 or more. Moreover, the scanning line driving circuit 20 has the same configuration as that of the data line driving circuit 30.

Each of the shift register unit circuits A1 to An has first and second clocked inverters 71 and 72, and an inverter 73. The output ends of the first and second clocked inverters 71 and 72 are connected to the input end of the inverter 73, and the output end of the inverter 73 is connected to the input end of the second clocked inverter 72.

One of the X clock signal XCK and the inverted X clock signal XCKB is supplied to the control terminal of the first clocked inverter 71, and the other is supplied to the control terminal of the second clocked inverter 72.

Therefore, if the X transmission start signal DX is set to be active at the H level is supplied to the data line driving circuit 30, the shift register unit circuits A1 to An transmit the X transmission start signal DX in synchronization with the clock signals XCK and XCKB so as to output a pulse signal to the test signal 131 and to output the output signals P1 to Pn to the logical arithmetic unit circuits B1 to B(n−1).

Each of the logical arithmetic unit circuits B1 to B(n−1) has a NAND circuit 51 which calculates the logical product, inverts the logical product, and outputs the inverted logical product, and an inverter circuit 52 which inverts the output signal from the NAND circuit 51. Specifically, the output signal Pm from the shift register unit circuit Am and the output signal P(m+1) from the shift register unit circuit A(m+1) are input to the logical arithmetic unit circuit Bm (for example, m is a natural number of n−1 or less). The logical arithmetic unit circuit Bm calculates the logical product of the output signal Pm and the output signal P(m+1) and outputs the logical product as the sampling signal Smm.

Therefore, the logical arithmetic unit circuits B1 to B(n−1) individually generate the sampling signals Sm1 to Sm(n−1) on the basis of the output signals P1 to Pn from the shift register unit circuits A1 to An.

The test circuit 131 is a buffer circuit in which inverter circuits 61, 62, 63, and 64 are connected in series. The test circuit 131 amplifies the pulse signal from the data line driving circuit 30 and outputs an output signal XEP. Therefore, by hitting the test probe against the test circuit 131, the output signal XEP is detected, and it is checked that the data line driving circuit 30 reliably operates. Moreover, the test circuit 121 has the same configuration as that of the test circuit 131.

However, the data line driving circuit 30 outputs the pulse signal whenever the images of one frame are displayed. According to this configuration, transistors constituting the inverter circuits 61 to 64 of the test circuit 131 are repeatedly turned on and off by the pulse signal. Whenever the transistor is turned on, a breakthrough current is generated, capacitance of the transistors or wiring lines is charged, and thus power consumes. Accordingly, there is a problem in that, after the operation check, at the time of normal driving, power consumption of the test circuit 131 increases. Further, the same problem occurs in the scanning line driving circuit 20.

SUMMARY

An advantage of some aspects of the invention is that it provides a test circuit which can reduce power consumption, an electro-optical device, and an electronic apparatus.

According to a first aspect of the invention, a test circuit for detecting an output signal from a driving circuit includes a judging circuit which outputs a detection signal when the output signal output from the driving circuit has one polarity, but does not output the detection signal when the output signal has the other polarity, and an amplifying circuit which amplifies the signal from the judging circuit.

According to this configuration, the judging circuit judges the polarity of the output signal from the driving circuit, outputs the detection signal when the output signal has one polarity, but does not output the detection signal when the output signal has the other polarity. Accordingly, at the time of an operation check, the output signal from the driving circuit is set to have one polarity, and, at the time of normal driving, the output signal from the driving circuit is set to have the other polarity. That is, only by inverting the polarity of the output signal from the driving circuit at the time of the operation check and normal driving, it is possible to reduce how many times a transistor constituting an amplifying circuit is turned on or off. As a result, power consumption can be reduced.

Besides, since what is necessary is to invert the polarity of the output signal from the driving circuit at the time of the operation check and normal driving, a new signal system does not need to be provided.

In the test circuit according to the first aspect of the invention, it is preferable that the driving circuit be a shift register which, if a trigger signal is input, sequentially transmits and outputs the trigger signal in synchronization with a clock, and the judging circuit be a NAND circuit which inverts a logical product of the output signal from the shift register and the trigger signal and outputs the inverted logical product.

According to this configuration, if the trigger signal is set to be active at the H level, and an H level pulse signal is input to the shift register, the H level pulse signal is output from the shift register. Since the output signal from the shift register and the trigger signal simultaneously become the H level, the output of the judging circuit is fixed to the H level.

On the other hand, if the trigger signal is set to be active at the L level, and an L level pulse signal is input to the shift register, the L level pulse signal is output from the shift register. If one of the output signal from the shift register and the trigger signal becomes the L level, the output of the NAND circuit becomes the H level, and thus the H level pulse signal is output from the judging circuit.

Therefore, according to this test circuit, only by inputting the trigger signal to be active at the L level at the time of the operation check of the transistor and the trigger signal to be active at the H level at the time of normal driving, the output signal of the judging circuit can turn to the pulse signal at the time of the operation check, whereas the output signal of the judging circuit can be fixed at the time of normal driving. Therefore, at the time of normal driving, it is possible to reduce how many times the transistor constituting the amplifying circuit is turned on or off. As a result, power consumption can be reduced, and also the test circuit can be implemented with simple configuration. Further, it is possible to manufacture the test circuit to have the same size as that of the related art test circuit.

In the test circuit according to the first aspect of the invention, it is preferable that the driving circuit be a shift register which, if a trigger signal is input, sequentially transmits and outputs the trigger signal in synchronization with a clock, and the judging circuit be a NOR circuit which inverts a logical sum of the output signal from the shift register and the trigger signal and outputs the inverted logical sum.

According to this configuration, if the trigger signal is set to be active at the L level, and the L level pulse signal is input to the shift register, the L level pulse signal is output from the shift register. Since the output signal from the shift register and the trigger signal simultaneously become the L level, the output of the judging circuit is fixed to the H level.

On the other hand, if the trigger signal is set to be active at the H level, and the H level pulse signal is input to the shift register, the H level pulse signal is output from the shift register. If one of the output signal from the shift register and the trigger signal becomes the H level, the output of the NOR circuit becomes the L level, and thus the L level pulse signal is output from the judging circuit.

Therefore, according to this test circuit, only by inputting the trigger signal to be active at the H level at the time of the operation check of the transistor and the trigger signal to be active at the L level at the time of normal driving, the output signal of the judging circuit can turn to the pulse signal at the time of the operation check, whereas the output signal of the judging circuit can be fixed at the time of normal driving. Therefore, at the time of normal driving, it is possible to reduce how many times the transistor constituting the amplifying circuit is turned on or off. As a result, power consumption can be reduced, and also the test circuit can be implemented with simple configuration. Further, it is possible to manufacture the test circuit to have the same size as that of the related art test circuit.

In the test circuit according to the first aspect of the invention, it is preferable that the driving circuit be a demultiplexer which, if a control signal and an inverted control signal obtained by inverting the control signal are input, has a plurality of transfer gates to be turned on/off in synchronization with the control signal and the inverted control signal, and the judging circuit have a plurality of NOT circuits which individually invert the inverted control signal, a plurality of NAND circuits which correspondingly invert logical products of the output signals from the individual NOT circuits and the control signal corresponding to the inverted control signal, and output the inverted logical products, and a NOR circuit which calculates a negative logical product of the output signals from the plurality of NAND circuits.

Moreover, as the demultiplexer, for example, a 1:3 demultiplexer including a plurality of demultiplexer unit circuits each having one input and three outputs or a 1:6 demultiplexer including a plurality of demultiplexer unit circuits each having one input and six outputs can be used. Specifically, in case of the 1:3 demultiplexer, each of the demultiplexer unit circuits has three transfer gates. Further, in case of the 1:6 demultiplexer, each of the demultiplexer unit circuits has six transfer gates.

According to this configuration, if the control signal to be active at the H level and the inverted control signal are input to the demultiplexer, the inverted control signal is inverted by the NOT circuits. Accordingly, since the H level pulse signals are simultaneously input to the individual NAND circuits, the individual NAND circuits output the L level pulse signals. Since the timings when the individual control signals become active are different from one another, in the NOR circuit, at least one of the input signals from the individual NAND circuits is constantly in the H level. Therefore, the output signal of the NOR circuit is fixed to the L level.

On the other hand, if the control signal to be active at the L level and the inverted control signal are input to the demultiplexer, the inverted control signal is inverted by the NOT circuits. Accordingly, since the L level pulse signals are simultaneously input to the individual NAND circuits, the individual NAND circuits output the H level pulse signals. In the NOR circuit, if any one of the input signals from the individual NAND circuits becomes the H level, the output signal becomes the L level. Therefore, since the timings when the individual control signals become active are different from one another, the L level pulse signal is output from the NOR circuit.

Therefore, according to this test circuit, only by inputting the trigger signal to be active at the L level at the time of the operation check of the demultiplexer and the trigger signal to be active at the H level at the time of normal driving, the output signal of the judging circuit can turn to the pulse signal at the time of the operation check, whereas the output signal of the judging circuit can be fixed at the time of normal driving. Therefore, at the time of normal driving, it is possible to reduce how many times the transistor constituting the amplifying circuit is turned on or off. As a result, power consumption can be reduced, and also the test circuit can be implemented with simple configuration. Further, it is possible to manufacture the test circuit to have the same size as that of the related art test circuit.

By the way, although the pulse width of the control signal and the pulse width of the inverted control signal are normally the same, due to the operation failure of a level shifter which generates the control signal and the inverted control signal, an abnormality that the pulse width of the control signal or the inverted control signal is widened may occur.

According to the first aspect of the invention, the control signal to be active at the L level and the inverted control signal are input to the demultiplexer. In each NAND circuit of the judging circuit, when any one of the input signals is in the L level, the output signal becomes the H level. For this reason, each NAND circuit outputs the pulse signal having the same pulse width as that of the control signal or the inverted control signal having a wider pulse width. Further, in the NOR circuit, if any one of the input signals from the NAND circuits becomes the H level, the output signal becomes the L level. Therefore, the NOR circuit also outputs the pulse signal having the same pulse width as that of the control signal or the inverted control signal having the wider pulse width. As a result, the control signal or the inverted control signal having the wider pulse width can be detected, and thus the abnormality that the pulse width of the control signal or the inverted control signal is widened can be detected.

In the test circuit according to the first aspect of the invention, it is preferable that the driving circuit be a demultiplexer which, if a control signal and an inverted control signal obtained by inverting the control signal are input, has a plurality of transfer gates to be turned on/off in synchronization with the control signal and the inverted control signal, and the judging circuit have a plurality of NOT circuits which individually invert the inverted control signal, a plurality of first NOR circuits which correspondingly invert logical sums of the output signals from the individual NOT circuits and the control signal corresponding to the inverted control signal, and output the inverted logical sums, and a second NOR circuit which calculates a negative logical product of the output signals from the plurality of NOR circuits.

According to this configuration, if the control signal to be active at the H level and the inverted control signal are input to the demultiplexer, the inverted control signal is inverted by the NOT circuits. In each of the first NOR circuits, only when all input signals are in the L level, the output signal becomes the H level. Therefore, the individual first NOR circuits output the L level pulse signals. In the second NOR circuit, only when all input signals are in the L level, the output signal becomes the H signal. Since the timings when the individual control signals become active are different from one another, at least one of the input signals from the individual first NOR circuits is constantly in the H level. Therefore, the output signal of the second NOR circuit is fixed to the L level.

On the other hand, if the control signal to be active at the L level and the inverted control signal are input to the demultiplexer, the inverted control signal is inverted by the NOT circuits. Since the L level pulse signals are simultaneously input to the individual first NOR circuits, the H level pulse signals are output from the individual first NOR circuits. In the second NOR circuit, if any one of the signals becomes the H level, the output signal becomes the L signal. Therefore, since the timings when the individual control signals become active are different from one another, the L level pulse signal is output from the second NOR circuit.

Therefore, according to this test circuit, only by inputting the trigger signal to be active at the L level at the time of the operation check of the demultiplexer and the trigger signal to be active at the H level at the time of normal driving, the output signal of the judging circuit can turn to the pulse signal at the time of the operation check, whereas the output signal of the judging circuit can be fixed at the time of normal driving. Therefore, at the time of normal driving, it is possible to reduce how many times the transistor constituting the amplifying circuit is turned on or off. As a result, power consumption can be reduced, and also the test circuit can be implemented with simple configuration. Further, it is possible to manufacture the test circuit to have the same size as that of the related art test circuit.

By the way, although the pulse width of the control signal and the pulse width of the inverted control signal are normally the same, due to the operation failure of the level shifter which generates the control signal and the inverted control signal, an abnormality that the pulse width of the control signal or the inverted control signal narrows may occur.

According to the first aspect of the invention, the control signal to be active at the L level and the inverted control signal are input to the demultiplexer. In each first NOR circuit of the judging circuit, when any one of the input signals becomes the H level, the output signal becomes the L level. Therefore, each first NOR circuit outputs the pulse signal having the same pulse width as that of the control signal or the inverted control signal having a narrower pulse width. Further, in the second NOR circuit, if any one of the input signals becomes the H level, the output signal becomes the L level. For this reason, the second NOR circuit outputs the pulse signal having the same pulse width as that of the control signal or the inverted control signal having the narrower pulse width. As a result, the control signal or the inverted control signal having the narrower pulse width can be detected, and thus an abnormality that the pulse width of the control signal or the pulse width of the inverted control signal narrows can be detected.

According to a second aspect of the invention, an electro-optical device includes a plurality of scanning lines, a plurality of data lines which intersect the scanning lines, a plurality of pixel circuits which are provided at intersections between the scanning lines and the data lines, a data line driving circuit which drives the data lines, and a scanning line driving circuit which drives the scanning lines. In this case, at least one of the data line driving circuit and the scanning line driving circuit has the test circuit described above.

According to this configuration, the same effects described above can be obtained.

According to a third aspect of the invention, an electronic apparatus includes the electro-optical device described above.

According to this configuration, the same effects described above can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
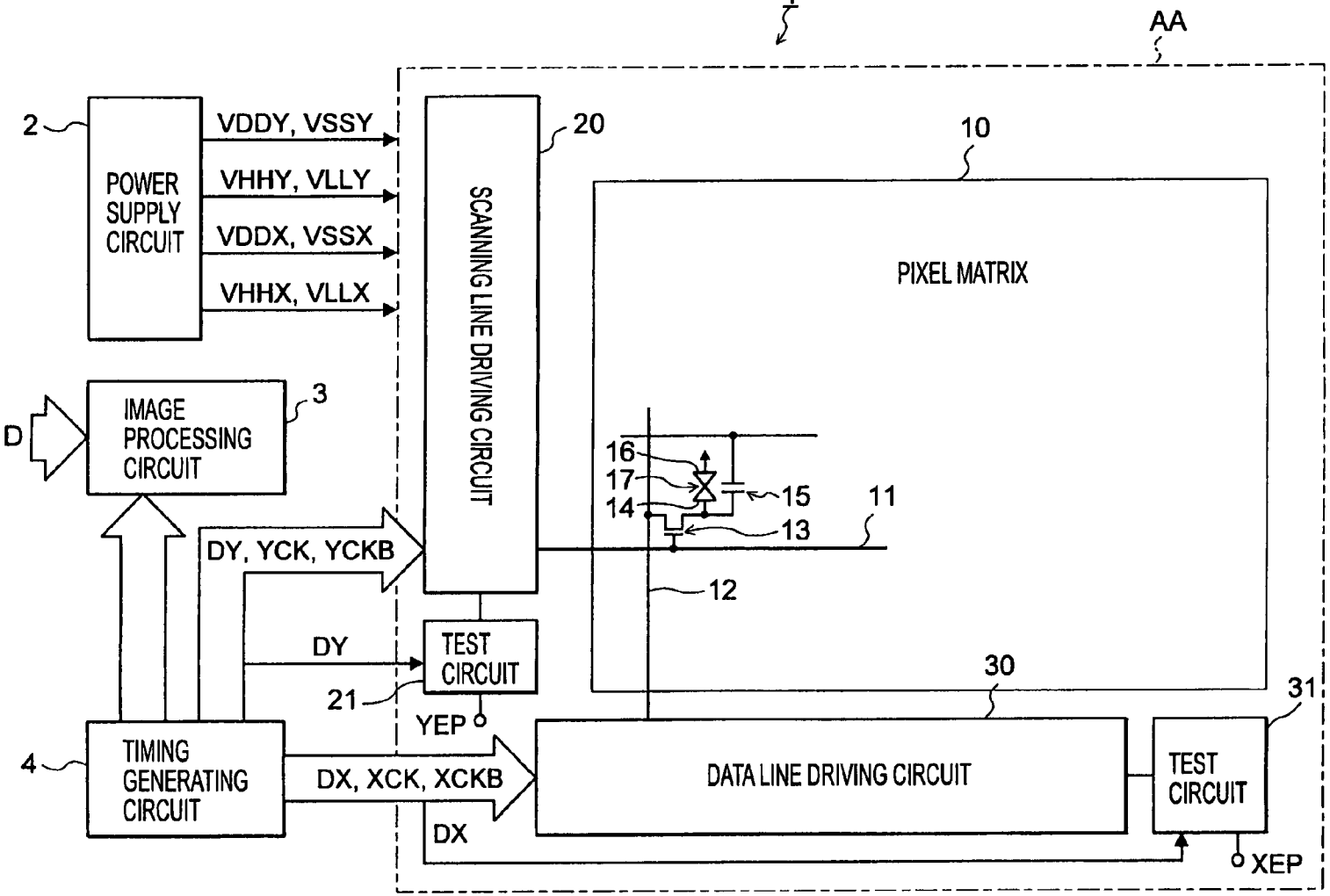
FIG. 1 is a block diagram showing the configuration of an electro-optical device according to a first embodiment of the invention.

Hereinafter, embodiments of the invention will be described with reference to the drawings. Moreover, in the following description, the same parts are represented by the same reference numerals, and the descriptions thereof will be omitted.

First Embodiment

Figure 2:
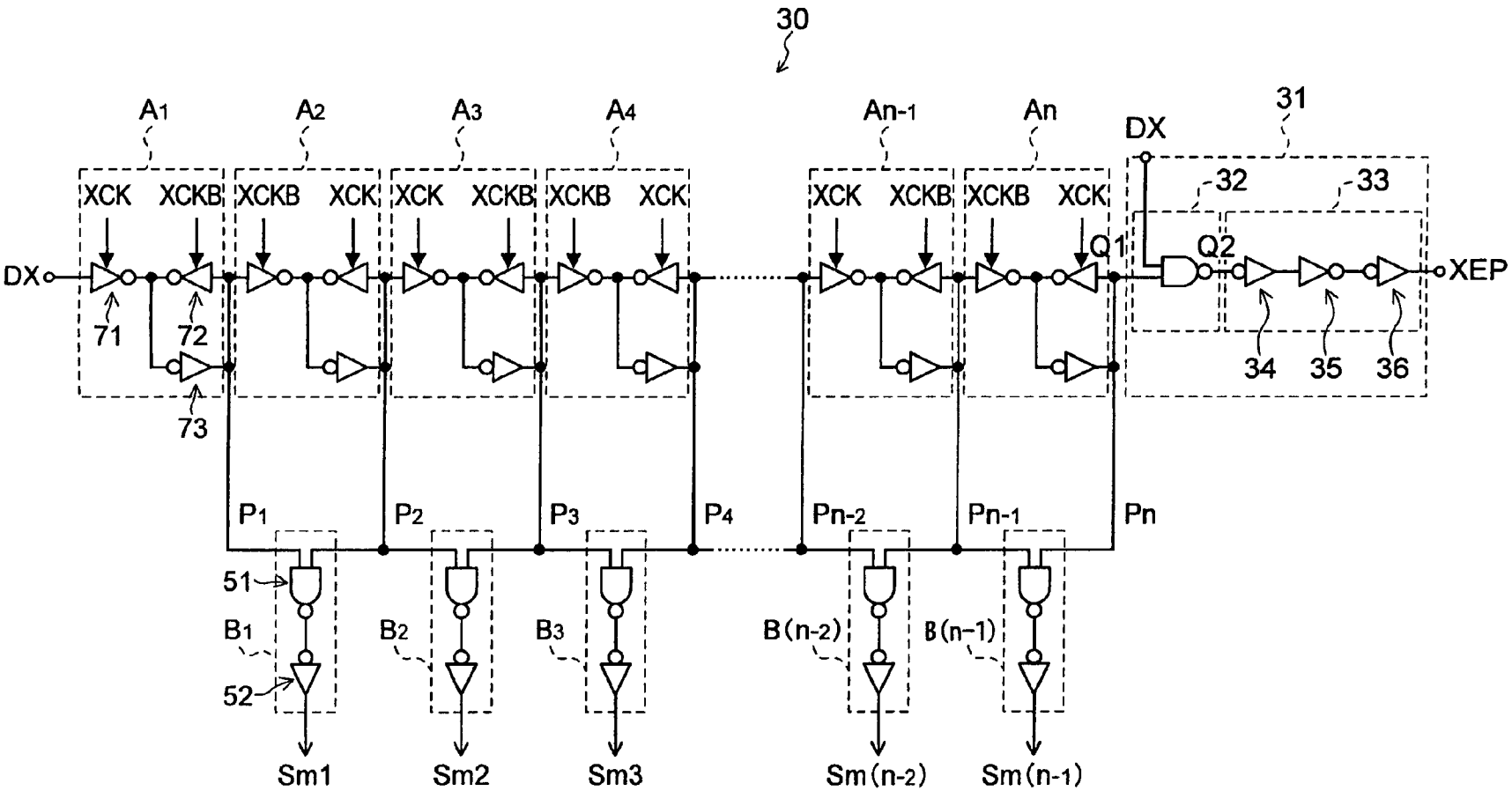
FIG. 2 is a circuit diagram of a data line driving circuit and a test circuit according to the first embodiment.
Figure 14:
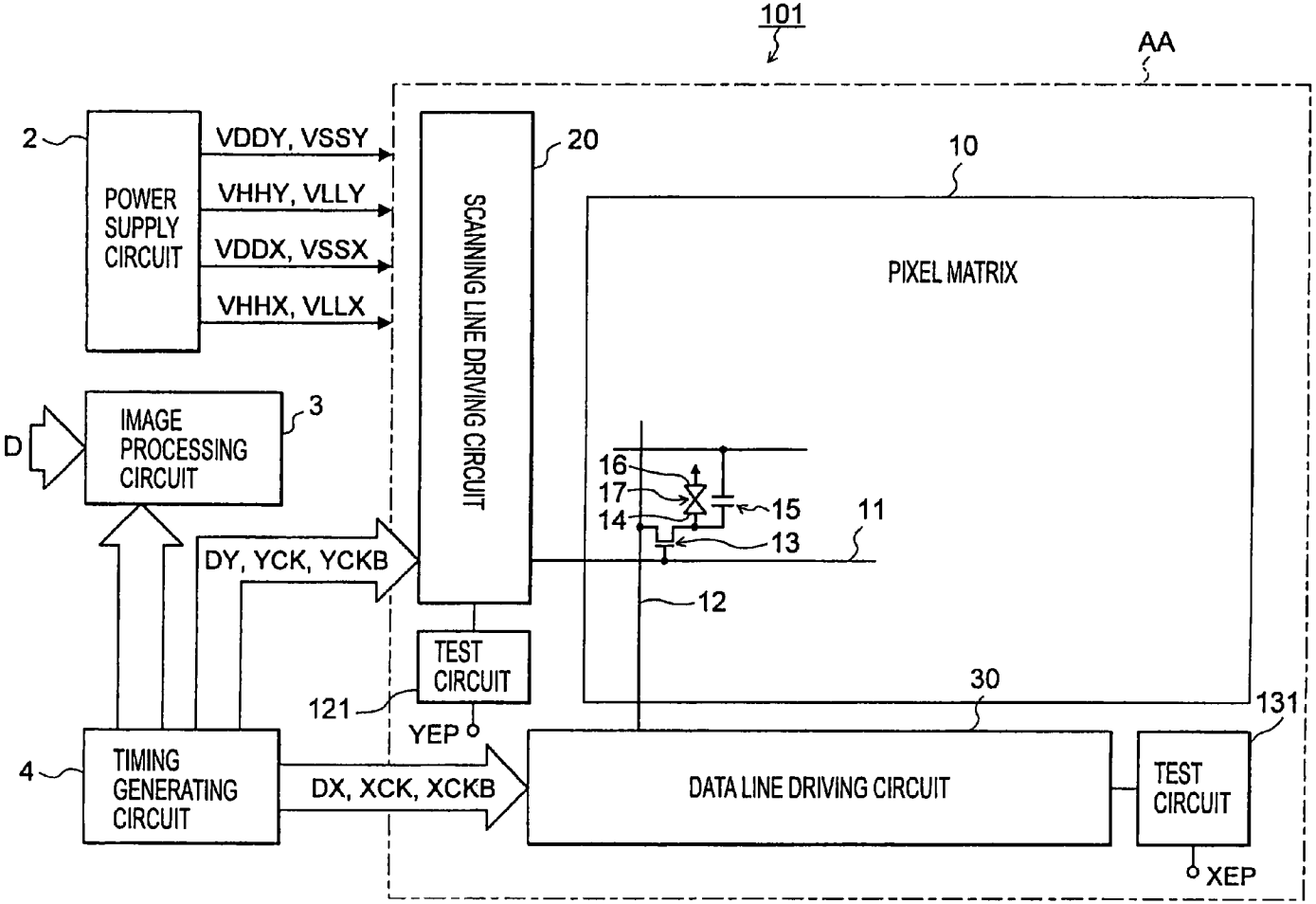
FIG. 14 is a block diagram showing the configuration of an electro-optical device according to the related art.
Figure 15:
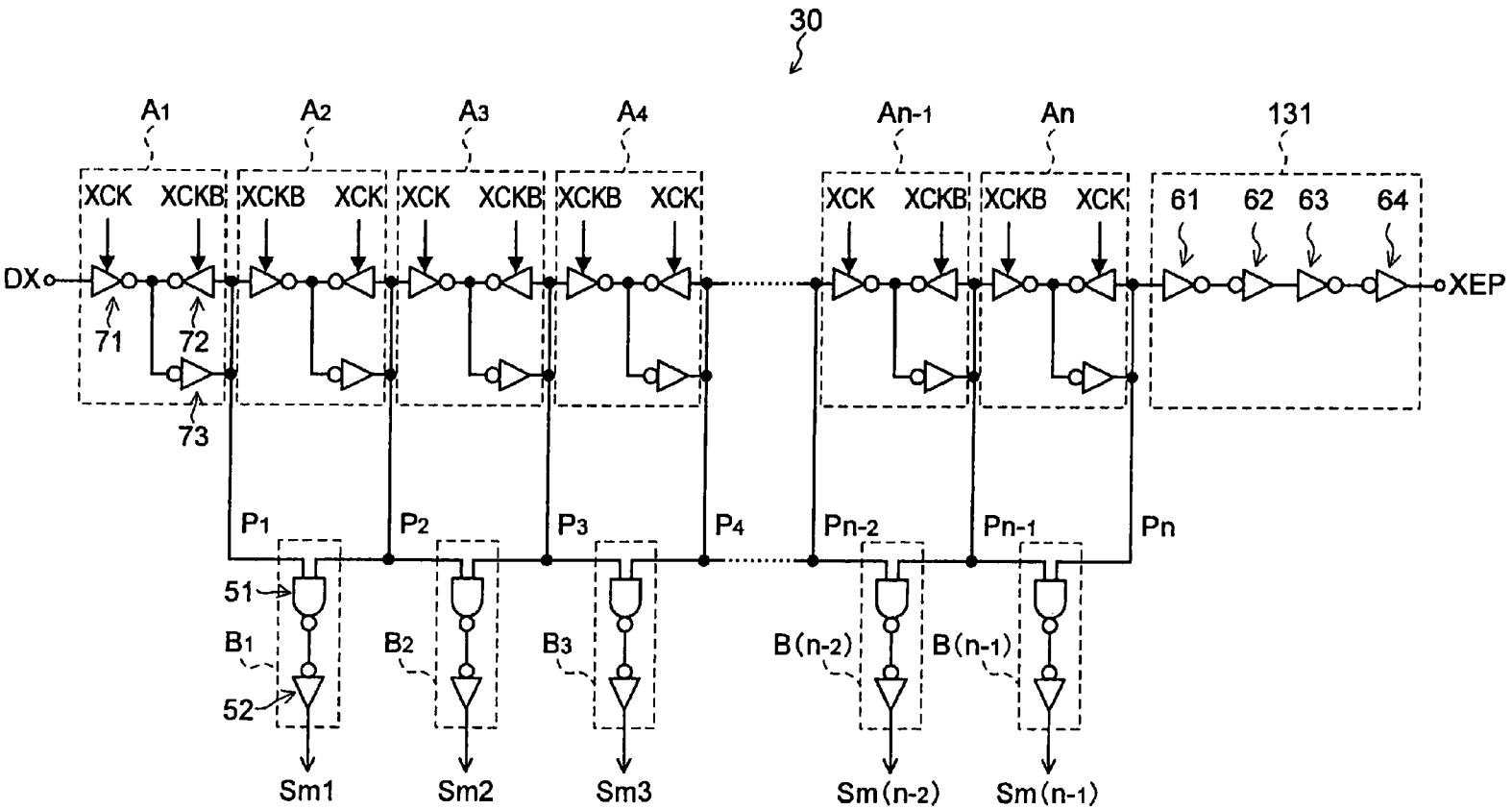
FIG. 15 is a circuit diagram of a data line driving circuit and a test circuit according to the related art.

FIG. 1 is a block diagram showing the configuration of an electro-optical device 1 to which a test circuit according to a first embodiment of the invention is applied. FIG. 2 is a circuit diagram of a data line driving circuit and a test circuit of the electro-optical device 1. Moreover, in FIGS. 1 and 2, the same parts as those of the electro-optical device 101 shown in FIGS. 14 and 15 are represented by the same reference numerals, and the descriptions thereof will be omitted.

In this embodiment, test circuits 21 and 31 of the electro-optical device 1 have the configuration different from those of the electro-optical device 101.

That is, on the element substrate of the liquid crystal panel AA of the electro-optical device 1, in addition to a pixel matrix 10, a scanning line driving circuit 20, a data line driving circuit 30, test circuits 21 and 31 are formed.

Hereinafter, the test circuit 31 will be described, but the test circuit 21 has the same configuration as that of the test circuit 31.

The test circuit 31 has a judging circuit 32 which outputs a detection signal when an output signal XEP from the data line driving circuit 30 has one polarity, but does not output the detection signal when the output signal XEP has the other polarity, and an amplifying circuit 33 which amplifies the signal from the judging circuit 32.

The judging circuit 32 is a NAND circuit which inverts a logical product of the output signal from the data line driving circuit 30 and a transmission start signal DX and outputs the inverted logical product.

The amplifying circuit 33 has three inverter circuits 34, 35, and 36 which are connected in series.

Next, the operation of the test circuit 31 at the time of normal driving will be described.

Figure 3:
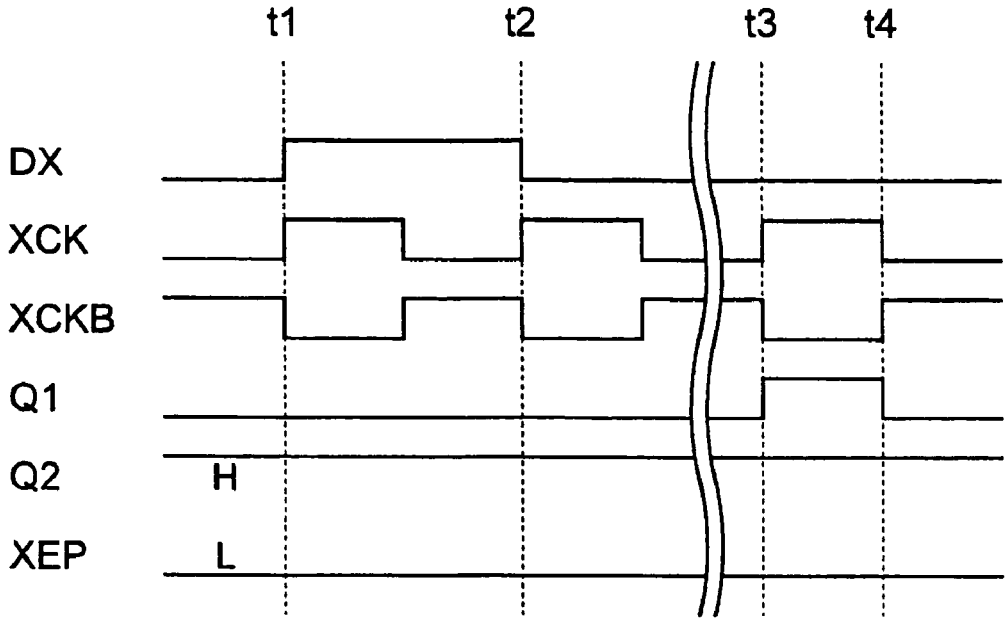
FIG. 3 is a timing chart of the test circuit according to the first embodiment at the time of normal driving.

FIG. 3 is a timing chart of the test circuit 31 at the time of normal driving.

First, if the transmission start signal X which becomes the H level from the time t1 to the time t2 is input to the data line driving circuit 30, the transmission start signal DX is transmitted in synchronization with an X clock signal XCK and an inverted x clock signal XCKB. As a result, an output signal Q1 becomes the H level from the time t3 to the time t4.

Therefore, since the transmission start signal DX and the output signal Q1 do not simultaneously become the H level, an output signal Q2 of the judging circuit 32 is fixed to the H level, and the output signal XEP is fixed to the L level.

Next, the operation of the test circuit 31 at the time of test driving will be described.

Figure 4:
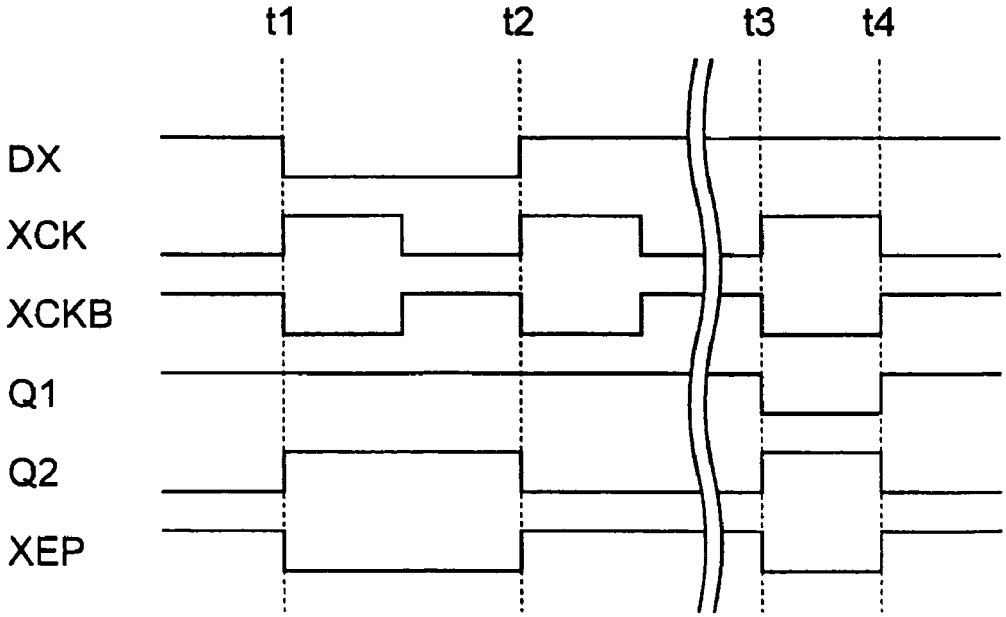
FIG. 4 is a timing chart of the test circuit according to the first embodiment at the time of test driving.

FIG. 4 is a timing chart of the test circuit 31 at the time of test driving.

First, if the transmission start signal DX which becomes the L level from the time t1 to the time t2 is input, the transmission start signal DX is transmitted in synchronization with the X clock signal XCK and the inverted X clock signal XCKB. As a result, the output signal Q1 becomes the L level from the time t3 to the time t4.

Therefore, if one of the transmission start signal DX and the output signal Q1 becomes the L level, the output signal Q2 of the judging circuit 32 becomes the H level. Accordingly, the output signal Q2 of the judging circuit 32 becomes the H level from the time t1 to the time t2 and from the time t3 to the time t4. Therefore, the output signal XEP becomes the L level from the time t1 to the time t2 and from the time t3 to the time t4.

According to this embodiment, the following effects are obtained.

(1) The judging circuit 32 judges the polarity of the output signal Q1 from the data line driving circuit 30, turns the output signal Q2 to the H level when the output signal Q1 is in the H level, and turns the output signal Q2 to the L level when the output signal Q1 is in the L level. Accordingly, only by turning the output signal Q1 from the data line driving circuit 30 turns to the L level at the time of the operation check and turning the output signal Q1 from the data line driving circuit 30 to the H level at the time of normal driving, that is, only by inverting the polarity of the output signal Q1 from the data line driving circuit 30 at the time of the operation check and normal driving, it is possible to reduce how many times a transistor constituting the amplifying circuit is turned on or off. As a result, it is possible to reduce power consumption.

Besides, since what is necessary is to invert the polarity of the output signal Q1 from the data line driving circuit 30 at the time of the operation check and normal driving, a new signal system does not need to be provided.

(2) Only by inputting the transmission start signal DX to be active at the L level at the time of the operation check of the data line driving circuit 30 and the transmission start signal DX to be active at the H level at the time of normal driving, the output signal of the judging circuit 32 can turn to the pulse signal at the time of the operation check, whereas the output signal of the judging circuit 32 can be fixed at the time of normal driving. Therefore, at the time of normal driving, it is possible to reduce how many times the transistor constituting the amplifying circuit 33 is turned on or off. As a result, power consumption can be reduced, and also the test circuit 31 can be implemented with simple configuration. Further, it is possible to manufacture the test circuit 31 to have the same size as that of the related art test circuit.

Second Embodiment

Figure 5:
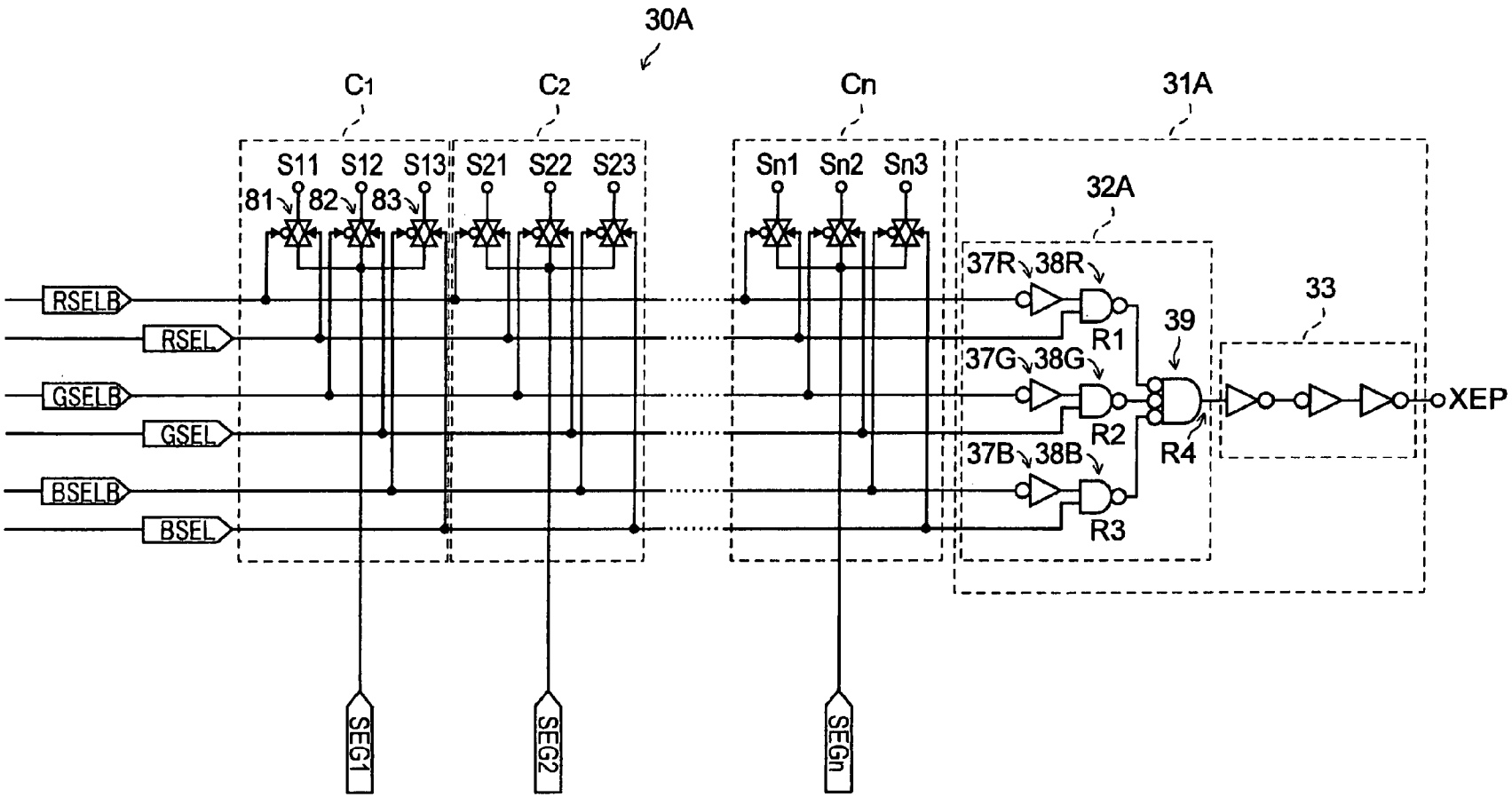
FIG. 5 is a circuit diagram of a data line driving circuit and a test circuit according to a second embodiment of the invention.

FIG. 5 is a circuit diagram of a data line driving circuit 30A and a test circuit 31A according to a second embodiment of the invention.

In this embodiment, the configuration of the data line driving circuit 30A is different from that in the first embodiment.

The data line driving circuit 30A has n demultiplexer unit circuits C1 to Cn. Here, n is a natural number of 2 or more.

Each of the demultiplexer unit circuits C1 to Cn has first, second, and third transfer gates 81, 82, and 83 each having a CMOS. Specifically, in the demultiplexer unit circuit Cm (for example, m is a natural number of n or less), one ends of the first to third transfer gates 81 to 83 are connected to an input terminal SEGm, and the other ends are correspondingly connected to output terminals Sm1 to Sm3.

The output terminals Sm1 to Sm3 are correspondingly connected to the data lines 12 of individual R (red), G (green), and B (blue) colors (see FIG. 1). That is, the individual demultiplexer unit circuits C supply the image signals to subpixels of R (red), G (green), and B (blue).

An image signal in which image data of individual R (red), G (green), and B (blue) colors are mixed is input to the input terminal SEGm.

Control terminals of the first transfer gates 81 of the demultiplexer unit circuits C1 to Cn are connected to control terminals RSEL and RSELB. An R control signal is supplied to the control terminal RSEL, and an inverted R control signal obtained by inverting the R control signal is supplied to the control terminal RSELB.

If the R control signal and the inverted R control signal become active, the transfer gate 81 is turned on, and then the image signal input from the input terminal SEGm is supplied to the R (red) data line 12.

Control terminals of the second transfer gates 82 of the demultiplexer unit circuits C1 to Cn are connected to control terminals GSEL and GSELB. A G control signal is supplied to the control terminal GSEL, and an inverted G control signal obtained by inverting the G control signal is supplied to the control terminal GSELB.

If the G control signal and the inverted G control signal become active, the transfer gate 82 is turned on, and then the image signal input from the input terminal SEGm is supplied to the G (green) data line 12.

Control terminals of the third transfer gates 83 of the demultiplexer unit circuits C1 to Cn are connected to control terminals BSEL and BSELB. A B control signal is supplied to the control terminal BSEL, and an inverted B control signal obtained by inverting the B control signal is supplied to the control terminal BSELB.

If the B control signal and the inverted B control signal become active, the transfer gate 83 is turned on, and then the image signal input from the input terminal SEGm is supplied to the B (blue) data line 12.

The data line driving circuit 30A described above operates as follows.

The image signals are supplied to SEG1 to SEGn of the demultiplexer unit circuits C1 to Cn, and one of the R control signal and the inverted R control signal, the G control signal and the inverted G control signal, and the B control signal and the inverted B control signal becomes active. Accordingly, a specified data line 12 from the data lines 12 of the individual R (red), G (green), and B (blue) colors can be selected, and the image signal can be supplied to the selected data line 12.

Therefore, from the image signal in which image data of the individual R (red), G (green), and B (blue) colors are mixed, image data of the individual R (red), G (green), and B (blue) can be extracted.

The test circuit 31A has a judging circuit 32A and an amplifying circuit 33.

The judging circuit 32A has three NOT circuits 37R, 37G, and 37B which individually inverts the inverted control signal, three NAND circuits 38R, 38G, and 38B which inverts logical products of the output signals from the NOT circuits 37R to 37B and the control signal corresponding to the inverted control signal and outputs the inverted logical products, and a NOR circuit 39 which calculates a negative logical product of the output signals from the three NAND circuits 38R to 38B.

Specifically, the NOT circuit 37R inverts and outputs the inverted R control signal. The NOT circuit 37G inverts and outputs the inverted G control signal. The NOT circuit 37B inverts and outputs the inverted B control signal.

The NAND circuit 38R inverts the logical product of the output signal of the NOT circuit 37R and the R control signal and outputs the inverted logical product as an output signal R1. The NAND circuit 38G inverts the logical product of the output signal of the NOT circuit 37G and the G control signal and outputs the inverted logical product as an output signal R2. The NAND circuit 38B inverts the logical product of the output signal of the NOT circuit 37B and the B control signal and outputs the inverted logical product as an output signal R3.

The NOR circuit 39 calculates the negative logical product of the output signals R1 to R3 of the three NAND circuits 38R to 38B and outputs the negative logical product as an output signal R4.

Next, the operation of the test circuit 31A at the time of normal driving will be described.

Figure 6:
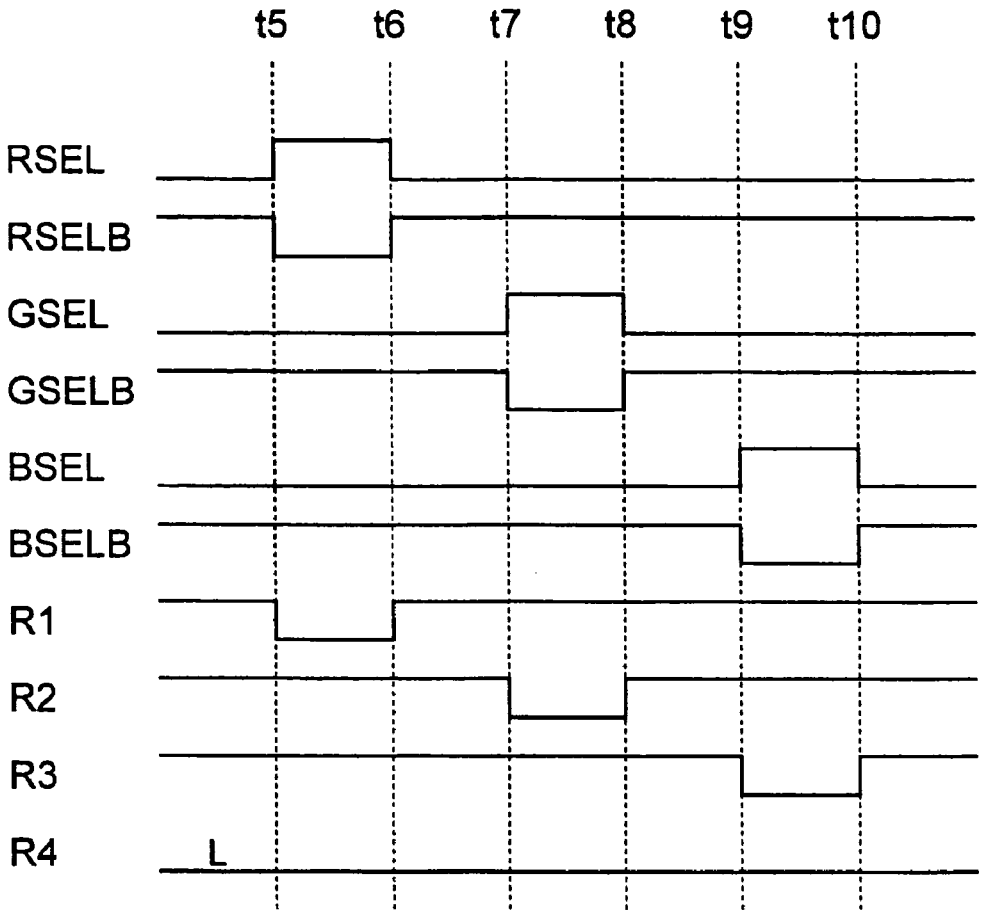
FIG. 6 is a timing chart of the test circuit according to the second embodiment at the time of normal driving.

FIG. 6 is a timing chart of the test circuit 31A at the time of normal driving.

The R control signal which becomes the H level from the time t5 to the time t6, and the inverted R control signal which becomes the L level from the time t5 to the time t6 are input to the test circuit 31A. Accordingly, the control terminal RSEL becomes the H level from the time t5 to the time t6, and the control terminal RSELB becomes the L level from the time t5 to the time t6.

Further, the G control signal which becomes the H level from the time t7 to the time t8, and the inverted G control signal which becomes the L level from the time t7 to the time t8 are input to the test circuit 31A. Accordingly, the control terminal GSEL becomes the H level from the time t7 to the time t8, and the control terminal GSELB becomes the L level from the time t7 to the time t8.

Further, the B control signal which becomes the H level from the time t9 to the time t10, and the inverted B control signal which becomes the L level from the time t9 to the time t10 are input to the test circuit 31A. Accordingly, the control terminal BSEL becomes the H level from the time t9 to the time t10, and the control terminal BSELB becomes the L level from the time t9 to the time t10.

The inverted control signals input from the control terminals RSELB, GSELB, and BSELB are individually inverted by the NOT circuits 37R to 37B. Accordingly, in the individual NAND circuits 38R to 38B, the H level pulse signals are simultaneously input, and thus the individual NAND circuits 38R to 38B output the L level pulse signals. That is, the output signal R1 of the NAND circuit 38R becomes the L level from the time t5 to the time t6. Further, the output signal R2 of the NAND circuit 38G becomes the L level from the time t7 to the time t8. In addition, the output signal R3 of the NAND circuit 38B becomes the L level from the time t9 to the time t10.

In the NOR circuit 39, if any one of the output signals R1 to R3 becomes the H level, the output signal R4 becomes the L level. As described above, since the timings when the output signals R1 to R3 become the L level are different from one another, at least two of the output signals R1 to R3 constantly become the H level. Therefore, the output signal R4 of the NOR circuit 39 is fixed to the L level.

Figure 7:
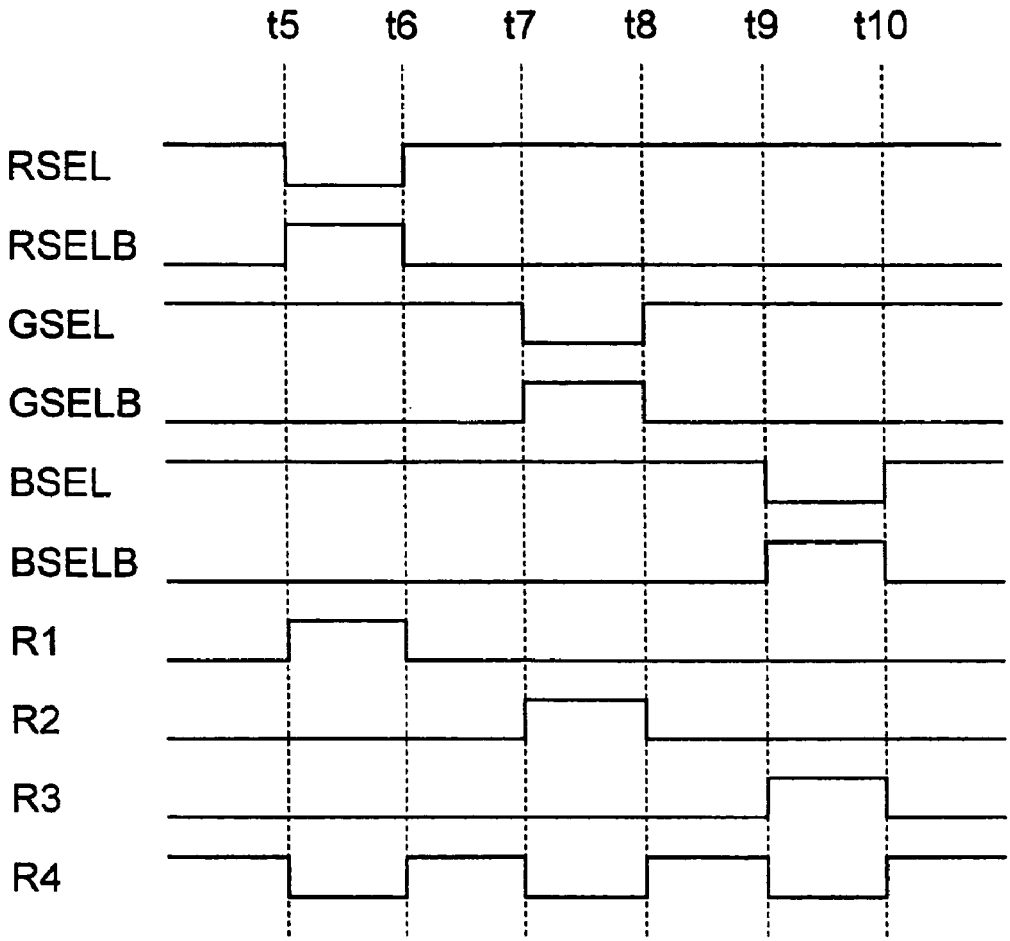
FIG. 7 is a first timing chart of the test circuit according to the second embodiment at the time of test driving.

FIG. 7 is a first timing chart of the test circuit 31A at the time of test driving.

The R control signal which becomes the L level from the time t5 to the time t6, and the inverted R control signal which becomes the H level from the time t5 to the time t6 are input to the test circuit 31A. Accordingly, the control terminal RSEL becomes the L level from the time t5 to the time t6, and the control terminal RSELB becomes the H level from the time t5 to the time t6.

Further, the G control signal which becomes the L level from the time t7 to the time t8, and the inverted G control signal which becomes the H level from the time t7 to the time t8 are input to the test circuit 31A. Accordingly, the control terminal GSEL becomes the L level from the time t7 to the time t8, and the control terminal GSELB becomes the H level from the time t7 to the time t8.

Further, the B control signal which becomes the L level from the time t9 to the time t10, and the inverted B control signal which becomes the H level from the time t9 to the time t10 are input to the test circuit 31A. Accordingly, the control terminal BSEL becomes the L level from the time t9 to the time t10, and the control terminal BSELB becomes the H level from the time t9 to the time t10.

The inverted control signals input from the control terminals RSELB, GSELB, and BSELB are individually inverted by the NOT circuits 37R to 37B. Accordingly, in the individual NAND circuits 38R to 38B, the L level pulse signals are simultaneously input, and thus the individual NAND circuits 38R to 38B output the H level pulse signals. That is, the output signal R1 of the NAND circuit 38R becomes the H level from the time t5 to the time t6. Further, the output signal R2 of the NAND circuit 38G becomes the H level from the time t7 to the time t8. In addition, the output signal R3 of the NAND circuit 38B becomes the H level from the time t9 to the time t10.

In the NOR circuit 39, if any one of the output signals R1 to R3 of the NAND circuits 38R to 38B becomes the H level, the output signal R4 becomes the L level. Therefore, at the timings when the output signals R1 to R3 become the H level, the output signal R4 becomes the L level. That is, the output signal R4 of the NOR circuit 39 becomes the L level from the time t5 to the time t6, from the time t7 to the time t8, and from the time t9 to the time t10.

Figure 8:
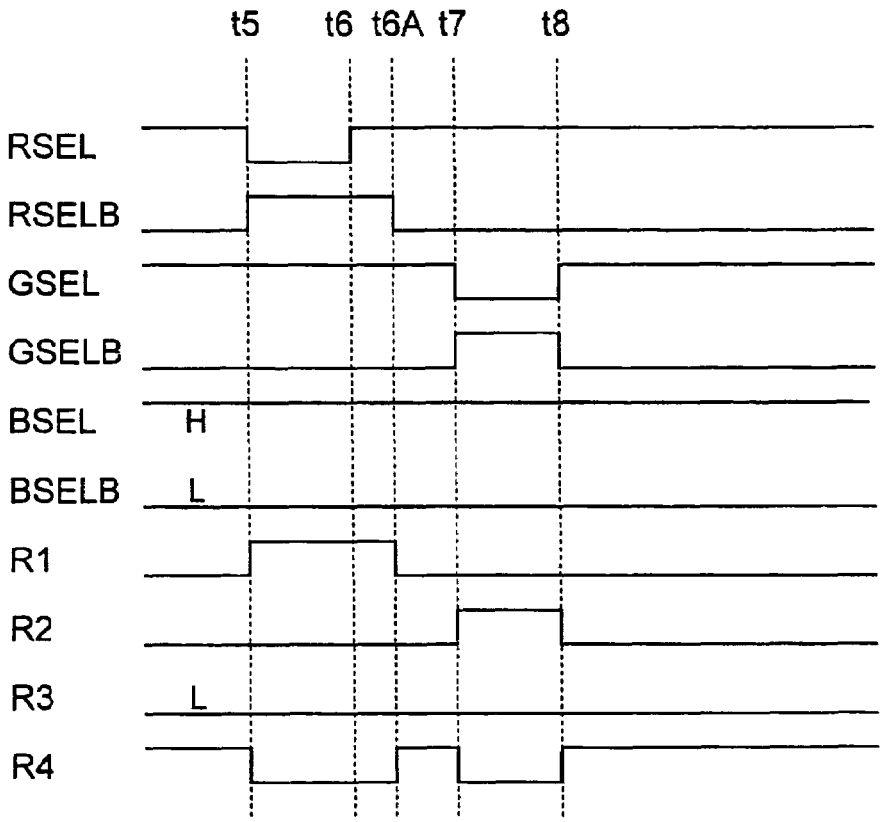
FIG. 8 is a second timing chart of the test circuit according to the second embodiment at the time of test driving.

FIG. 8 is a second timing chart of the test circuit 31A at the time of test driving.

The second timing chart is different from the first timing chart in that, since an inconsistency exists in the data line driving circuit 30A, the pulse width of the inverted R control signal extends, and the B control signal and the inverted B control signal do not become active.

Specifically, the inverted R control signal which becomes the H level from the time t5 to the time t6A is input to the test circuit 31A. Accordingly, unlike the first timing chart, the control terminal RSELB becomes the H level from the time t5 to the time t6A.

Further, the R control signal and the inverted R control signal which do not become active are input the test circuit 31A. For this reason, a period in which the control terminal BSEL becomes the L level and a period in which the control terminal BSELB becomes the H level do not exist.

The inverted R control signal having a wider pulse width is inverted by the NOT circuit 37R. In the NAND circuit 38R, when any one of the input signals is in the L level, the output signal R1 becomes the H level. Therefore, since the output signal from the NOT circuit 37R has a wider pulse width, the NAND circuit 38R outputs the pulse signal having the same pulse width as that of the output signal of the NOT circuit 37R. That is, the output signal R1 of the NAND circuit 38R becomes the H level from the time t5 to the time t6. In the NOR circuit 39, if any one of the output signals R1 to R3 becomes the H level, the output signal R4 becomes the L level. Therefore, the output signal R4 of the NOR circuit 39 becomes the L level from the time t5 to the time t6.

Since the B control signal and the inverted B control signal are inactive, the H level signal is constantly input to the NAND circuit 38B. Accordingly, the output signal R3 of the NAND circuit 38B is in the L level. In the NOR circuit 39, as long as at least one of the output signals R1 to R3 becomes the H level, the output signal R4 does not become the L level. Therefore, the output signal R4 of the NOR circuit 39 is fixed to the H level.

According to this embodiment, in addition to the effects (1) and (2) described above, the following effect is obtained.

(3) If the inverted R control signal having the wider pulse width is input to the data line driving circuit 30A, the NAND circuit 38R outputs the pulse signal having the same pulse width as that of the inverted R control signal. Therefore, the NOR circuit 39 also outputs the pulse signal having the same pulse width as that of the inverted R control signal. As a result, the R control signal or the inverted R control signal having the wider pulse width can be detected, and thus an abnormality that the pulse width of the R control signal or the inverted R control signal is widened can be detected.

Third Embodiment

Figure 9:
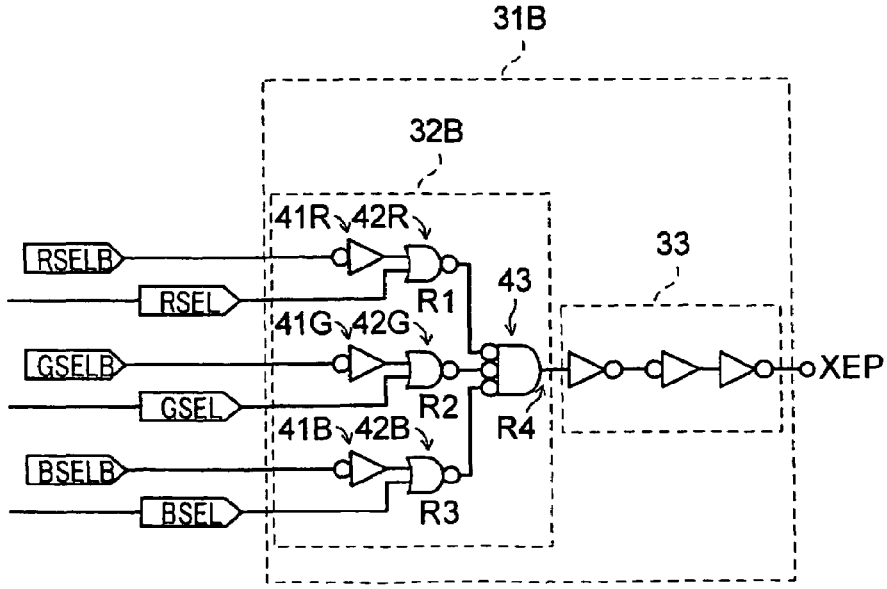
FIG. 9 is a circuit diagram of a test circuit according to a third embodiment of the invention.

FIG. 9 is a circuit diagram of a test circuit 31B according to a third embodiment of the invention.

In this embodiment, the configuration of the test circuit 31B is different from that in the second embodiment.

The test circuit 31B has a judging circuit 32B and an amplifying circuit 33.

The judging circuit 32B has three NOT circuits 41R, 41G, and 41B which individually invert the inverted control signal, three first NOR circuits 42R, 42G, and 42B which invert logical sums of the output signals from the NOT circuits 41R to 41B and the control signal corresponding to the inverted control signal and output the inverted logical sums, and a second NOR circuit 43 which calculates a negative logical product of the output signals of the three first NOR circuits 42R to 42B.

Specifically, the NOT circuit 41R inverts and outputs the inverted R control signal. The NOT circuit 41G inverts and outputs the inverted G control signal. The NOT circuit 41B inverts and outputs the inverted B control signal.

The first NOR circuit 42R inverts the logical sum of the output signal from the NOT circuit 41R and the R control signal and outputs the inverted logical sum as an output signal R1. The first NOR circuit 42G inverts the logical sum of the output signal from the NOT circuit 41G and the G control signal and outputs the inverted logical sum as an output signal R2. The first NOR circuit 42B inverts the logical sum of the output signal from the NOT circuit 41B and the B control signal and outputs the inverted logical sum as an output signal R3.

The second NOR circuit 43 calculates the negative logical product of the output signals R1 to R3 of the three NAND circuits 38R to 38B and outputs the negative logical product as an output signal R4.

Figure 10:
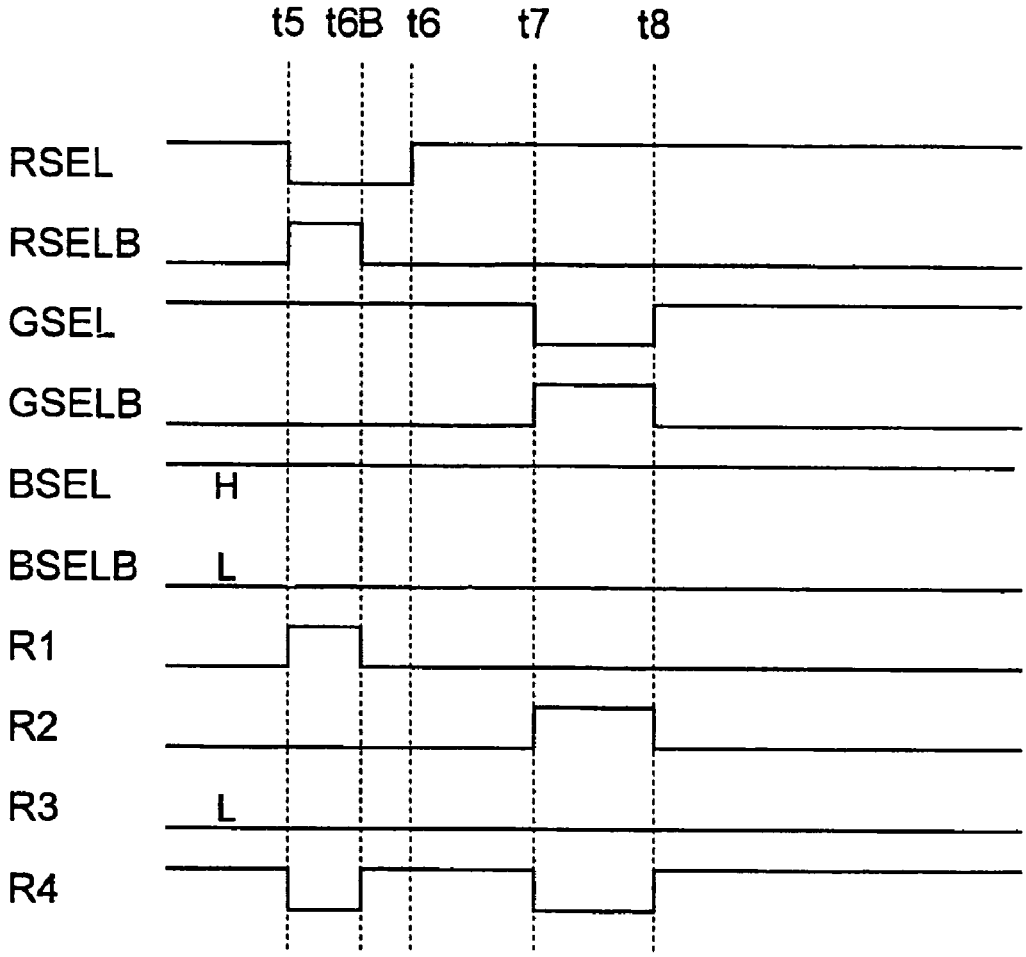
FIG. 10 is a timing chart of the test circuit according to the third embodiment at the time of test driving.

FIG. 10 is a timing chart of the test circuit 31B at the time of test driving.

The timing chart of this embodiment is different from the second timing chart of the first embodiment in that, since an inconsistency exists in the data line driving circuit 30A, the pulse width of the inverted R control signal is shortened.

Specifically, the inverted R control signal which becomes the H level from the time t5 to the time t6 is input to the test circuit 31B. Accordingly, the control terminal RSELB becomes the H level from the time t5 to the time t6.

The inverted R control signal having a narrower pulse width is inverted by the NOT circuit 41R. In the first NOR circuit 42R, if any one of the input signals becomes the H level, the output signal R1 becomes the H level. Therefore, since the output signal from the NOT circuit 41R has a narrower pulse width, the first NOR circuit 42R outputs the pulse signal having the same pulse width as that of the output signal of the NOT circuit 41R. That is, the output signal R1 of the first NOR circuit 42R becomes the H level from the time t5 to the time t6B. In the second NOR circuit 43, if any one of the output signals R1 to R3 becomes the H level, the output signal R4 becomes the L level. Therefore, the output signal R4 of the second NOR circuit 43 becomes the L level from the time t5 to the time t6B.

According to this embodiment, in addition to the effects (1) and (2) described above, the following effect is obtained.

(4) If the inverted R control signal having the narrower pulse width is input to the data line driving circuit 30A, the first NOR circuit outputs the pulse signal having the same pulse width as that of the inverted R control signal. For this reason, the second NOR circuit also outputs the pulse signal having the same pulse width as that of the inverted R control signal. Therefore, the R control signal or the inverted R control signal having the narrower pulse width can be detected, and thus an abnormality that the pulse width of the R control signal or the inverted R control signal narrows can be detected.

Modifications

Moreover, the invention is not limited to the embodiments, but modifications or improvements within the scope capable of achieving the advantages of the invention still fall within the invention.

In the above-described embodiments, the scanning line driving circuit 20 and the test circuit 21, or the data line driving circuit 30 or 30A and the test circuit 31 are separately provided, but the invention is not limited to this configuration. For example, these circuits may be provided as a single body.

Further, in the first embodiment described above, the x transmission start signal DX is set to be active at the H level, and the judging circuit 32 is the NAND circuit which inverts the logical product of the output signal from the data line driving circuit 30 and the transmission start signal DX and outputs the inverted logical product, but the invention is not limited to this configuration. For example, the X transmission start signal DX may be set to be active at the L level, and the judging circuit may be a NAND circuit which inverts the logical product of the output signal from the data line driving circuit and the transmission start signal DX and outputs the inverted logical product.

With this configuration, in addition to the effect (1) described above, the following effect can be obtained.

(5) Only by inputting the transmission start signal DX to be active at the H level at the time of the operation check of the data line driving circuit 30 and the transmission start signal DX to be active at the L level at the time of normal driving, at the time of normal driving, it is possible to reduce how many times the transistor constituting the amplifying circuit is turned on or off. As a result, power consumption can be reduced, and the test circuit can be implemented with simple configuration. Further, it is possible to manufacture the test circuit to have the same size as that of the related art test circuit.

Further, in the above-described embodiments, the invention is applied to the electro-optical device 1 using liquid crystal, but the invention is not limited to this configuration. For example, the invention can be applied to an electro-optical device using an electro-optical material other than liquid crystal. The electro-optical material means a material whose optical characteristics, such as transmittance or luminance, is changed by the supply of an electrical signal (current signal or voltage signal). For example, the invention can be applied to various kinds of the electro-optical devices, such as a display panel using an OLED element such as an organic EL (electroluminescent) or light-emitting polymer as the electro-optical material, an electrophoresis display panel using a microcapsule including colored liquid and white particles dispersed in the liquid as the electro-optical material, a twisted ball display panel using twisted balls which are coated with different colors for regions having different polarities as the electro-optical material, a toner display panel using a black toner as the electro-optical material, or a plasma display panel using a high pressure gas such as helium or neon as the electro-optical material, like the above-described embodiments.

APPLICATIONS

Figure 11:
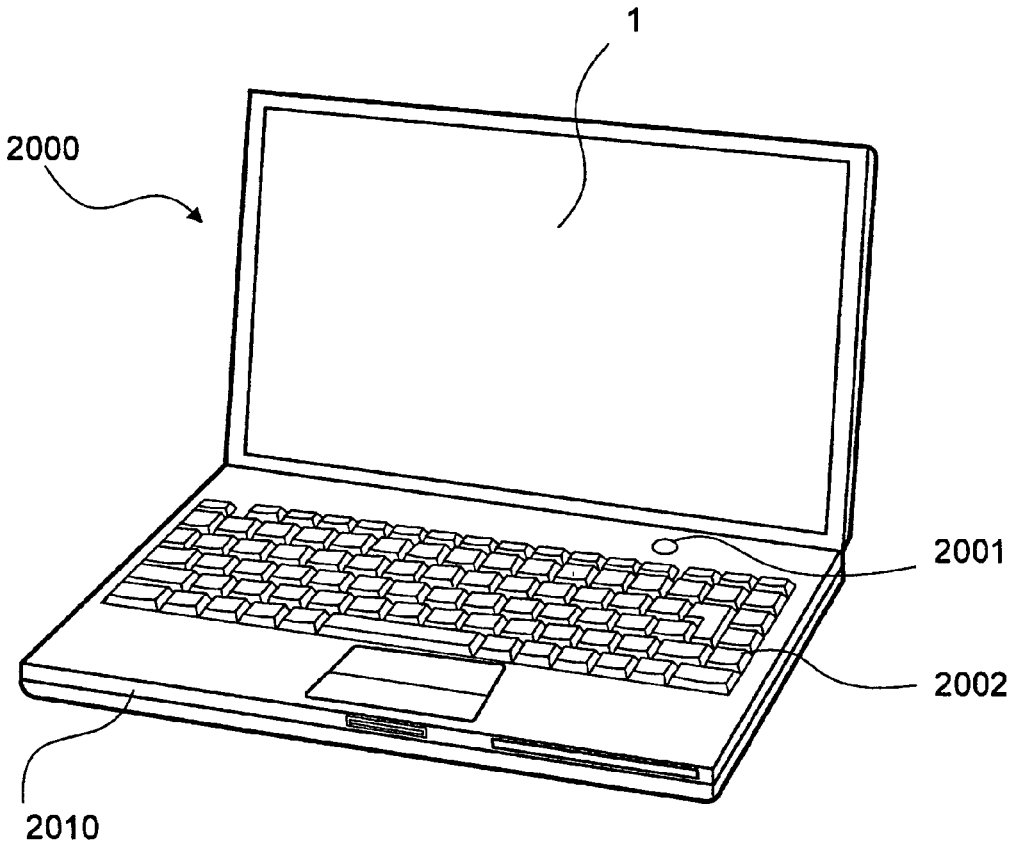
FIG. 11 is a perspective view showing a mobile personal computer to which the electro-optical device is applied.

FIG. 11 is a perspective view showing a mobile personal computer to which the electro-optical device 1 shown in FIG. 1 is applied. The personal computer 2000 has the electro-optical device 1 serving as a display unit, and a main body portion 2010. In the main body portion 2010, a power switch 2001 and a keyboard 2002 are provided. The electro-optical device of the personal computer 2000 has the above-described test circuit, and thus the reduction in power consumption can be realized.

Figure 12:
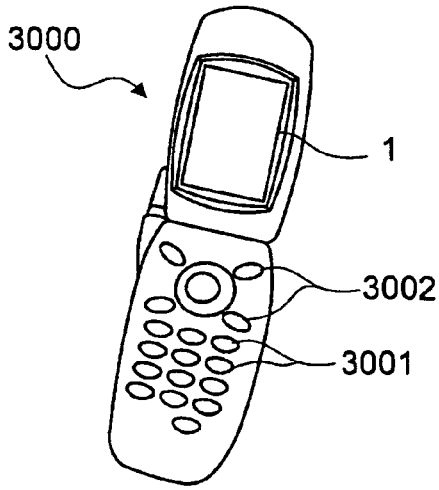
FIG. 12 is a perspective view showing a cellular phone to which the electro-optical device is applied.

FIG. 12 is a perspective view showing a cellular phone to which the electro-optical device shown in FIG. 1 is applied. The cellular phone 3000 has a plurality of operating buttons 3001, scroll buttons 3002, and the electro-optical device 1 serving as a display unit. The electro-optical device of the cellular phone 3000 has the above-described test circuit, and thus the reduction in power consumption can be realized.

Figure 13:
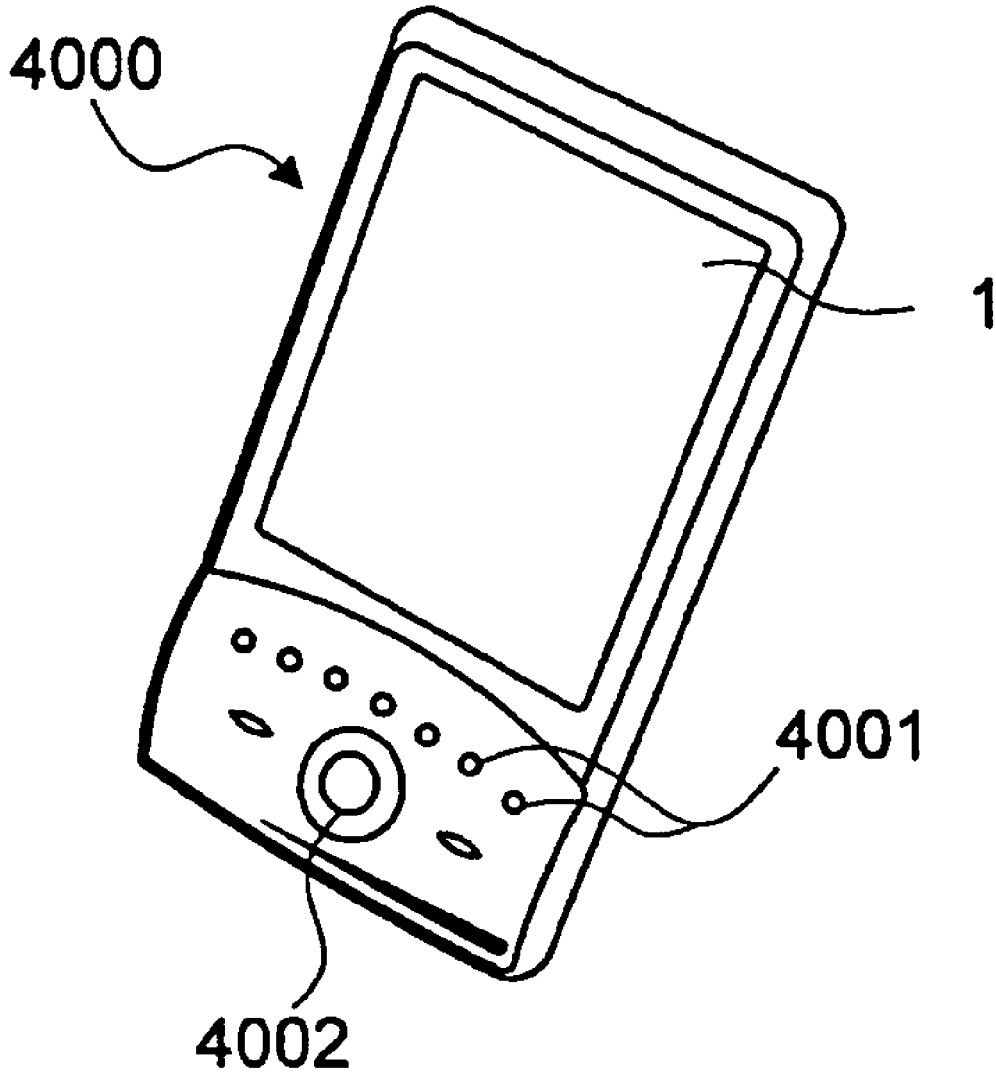
FIG. 13 is a perspective view showing a personal digital assistant to which the electro-optical device is applied.

FIG. 13 is a perspective view showing a personal digital assistant (PDA) to which the electro-optical device shown in FIG. 1 is applied. The personal digital assistant 4000 has a plurality of operating buttons 4001, a power switch 4002, and the electro-optical device 1 serving as a display unit. The electro-optical device of the personal digital assistant 4000 has the above-described test circuit, and thus the reduction in power consumption can be realized.

Moreover, as the electronic apparatus to which the electro-optical device of the embodiment shown in FIG. 1 is applied, in addition to the electronic apparatuses shown in FIGS. 13 to 15, a digital still camera, a liquid crystal television, a viewfinder-type or a monitor-direct-view-type video tape recorder, a car navigation device, a pager, an electronic organizer, an electronic calculator, a word processor, a workstation, a video phone, a POS terminal, or a touch panel can be exemplified.

The entire disclosure of Japanese Patent Application No. 2005-148071, filed May 20, 2005, is expressly incorporated by reference herein.

What is claimed is:

1. A test circuit for detecting an output signal from a driving circuit, comprising:

a judging circuit which outputs a detection signal when the output signal output from the driving circuit has one polarity, but does not output the detection signal when the output signal has the other polarity; and an amplifying circuit which amplifies the signal from the judging circuit, wherein the driving circuit is a demultiplexer which, if a control signal and an inverted control signal obtained by inverting the control signal are input, has a plurality of transfer gates to be turned on/off in synchronization with the control signal and the inverted control signal, and the judging circuit has a plurality of NOT circuits which individually invert the inverted control signal, a plurality of NAND circuits which correspondingly invert logical products of the output signals from the individual NOT circuits and the control signal corresponding to the inverted control signal, and output the inverted logical products, and a NOR circuit which calculates a negative logical product of the output signals from the plurality of NAND circuits.

2. An electro-optical device comprising:

a plurality of scanning lines;

a plurality of data lines which intersect the scanning lines;

a plurality of pixel circuits which are provided at intersections between the scanning lines and the data lines;

a data line driving circuit which drives the data lines; and a scanning line driving circuit which drives the scanning lines, wherein at least one of the data line driving circuit and the scanning line driving circuit has the test circuit according to claim 1.

3. An electronic apparatus comprising the electro-optical device according to claim 2.

* * * * *